US006536357B1

(12) United States Patent
Hiestand

(10) Patent No.: US 6,536,357 B1
(45) Date of Patent: Mar. 25, 2003

(54) HEIGHT ADJUSTABLE TABLE

(75) Inventor: Bernard Anton Hiestand, Wellington (NZ)

(73) Assignee: Formway Furniture Limited, Wellington (NZ)

( * ) Notice: Subject to any disclaimer, the term of this patent is extended or adjusted under 35 U.S.C. 154(b) by 0 days.

(21) Appl. No.: 09/585,683

(22) Filed: Jun. 1, 2000

(51) Int. Cl.[7] ..... A47B 57/00
(52) U.S. Cl. ..... 108/95; 108/144.11; 108/147
(58) Field of Search ..... 108/94, 95, 147, 108/61, 144.11; 248/125.9, 415, 157, 188.5, 243

(56) References Cited

U.S. PATENT DOCUMENTS

| | | | | |
|---|---|---|---|---|
| 109,107 | A | * | 11/1870 | Boardman |
| 2,251,841 | A | * | 8/1941 | Herold |
| 2,388,056 | A | * | 10/1945 | Hendricks |
| 3,738,286 | A | | 6/1973 | Hoffman |
| 3,885,764 | A | | 5/1975 | Pabreza |
| 3,888,444 | A | | 6/1975 | Yindra et al. |
| 3,913,901 | A | | 10/1975 | Molders |
| 3,979,099 | A | | 9/1976 | Strang |
| 4,097,016 | A | | 6/1978 | Petrucci |
| 4,183,689 | A | * | 1/1980 | Wirges et al. |
| 4,191,353 | A | | 3/1980 | Leonhardt |
| 4,285,488 | A | | 8/1981 | Hancock |
| 4,315,613 | A | | 2/1982 | Godwin et al. |
| 4,379,540 | A | | 4/1983 | French |
| 4,526,334 | A | | 7/1985 | Rantakari |
| 4,540,148 | A | | 9/1985 | Jann |
| 4,593,874 | A | | 6/1986 | Dunagan |
| 4,598,892 | A | | 7/1986 | Franckowiak et al. |
| 4,613,106 | A | | 9/1986 | Tornero |
| 4,627,591 | A | | 12/1986 | Heckmann |
| 4,627,602 | A | | 12/1986 | Sporck |
| 4,693,442 | A | | 9/1987 | Sills |

(List continued on next page.)

FOREIGN PATENT DOCUMENTS

| | | | |
|---|---|---|---|
| AU | 131396 | | 9/1997 |
| AU | 136783 | | 3/1999 |
| DE | 498078272 | | 2/1999 |
| FR | 1378935 | * | 10/1964 |
| GB | 2090571 | | 4/2000 |
| JP | 02283317 | | 11/1990 |
| JP | 2000189253 | | 7/2000 |
| JP | 2000210129 | | 8/2000 |
| NZ | 28297 | | 7/1997 |
| NZ | 29134 | | 6/1998 |

OTHER PUBLICATIONS

Formway Furniture Brochure, *Free System*, published Apr. 1999.

*Primary Examiner*—Jose V. Chen
(74) *Attorney, Agent, or Firm*—Workman, Nydegger & Seeley

(57) ABSTRACT

A height adjustable table assembly (10) has a table top (12) with an upper surface (20) and an outer periphery (14). The table assembly (10) also has a supporting base (38). A height adjustment mechanism (25, 54, 50) is provided to selectively raise or lower the table top (12) relative to the supporting base (38). The height adjustment mechanism (25, 54, 50) includes a height adjustment actuator (25) in the form of a rotatable member. The rotatable member (25) is selectively rotatable relative to the supporting base (38) to actuate the height adjustment mechanism (25, 54, 50) to selectively raise or lower the table top (12). The rotatable member (25) is disposed underneath the upper surface (20) of the table top (12) and has an outer edge (29) which terminates at or near the outer periphery (14) of the table top (12) for at least a portion of the outer periphery (14) of the table top (12). A resiliently deformable tether (40) may interconnect the table top and at least a portion of the support assembly (27). An O-ring (120) may also be provided between telescoping leg portions (24,36) of the support assembly (27).

48 Claims, 13 Drawing Sheets

U.S. PATENT DOCUMENTS

| | | | | |
|---|---|---|---|---|
| 4,705,256 | A | | 11/1987 | Hofrichter |
| 4,756,496 | A | | 7/1988 | Hosan et al. |
| 4,903,930 | A | | 2/1990 | Jann |
| 5,078,351 | A | | 1/1992 | Gualtieri |
| 5,115,723 | A | | 5/1992 | Wang |
| 5,120,011 | A | | 6/1992 | Mintgen et al. |
| 5,230,290 | A | * | 7/1993 | Crossman |
| 5,243,921 | A | * | 9/1993 | Kruse et al. |
| 5,289,782 | A | | 3/1994 | Rizzi et al. |
| 5,431,362 | A | | 7/1995 | Carnahan et al. |
| 5,433,409 | A | | 7/1995 | Knopp |
| 5,462,248 | A | | 10/1995 | Bauer |
| 5,513,825 | A | | 5/1996 | Gutgsell |
| 5,562,052 | A | | 10/1996 | Glashouwer et al. |
| 5,676,068 | A | | 10/1997 | Kallander |
| 5,720,369 | A | | 2/1998 | Thorn |
| 5,853,211 | A | | 12/1998 | Thoman et al. |
| D411,926 | S | | 7/1999 | Brown et al. |
| 5,941,182 | A | | 8/1999 | Greene |
| D418,997 | S | | 1/2000 | Leveen et al. |
| 6,056,251 | A | | 5/2000 | Knopp et al. |
| 6,082,680 | A | | 7/2000 | Woodward et al. |
| 6,131,870 | A | * | 10/2000 | Tseng |
| 6,148,741 | A | | 11/2000 | Motta |
| 6,182,583 | B1 | | 2/2001 | Larson |
| 6,199,806 | B1 | | 3/2001 | Sauer et al. |

* cited by examiner

HEIGHT ADJUSTABLE TABLE

FIELD OF THE INVENTION

The present invention relates to a height adjustable table. In particular, although not exclusively, the invention relates to a height adjustable table on which a computer monitor may be mounted. However, the invention is not limited to a stand-alone table and as such may be applicable to a work station which incorporates within it, a height adjustable table portion.

BACKGROUND TO THE INVENTION

Height adjustable tables are known. The type which is most commonly in use with computer monitors incorporates a pneumatic spring which assists with raising and lowering the table top by adjustment of an appropriate lever. A common difficulty with such tables is that the effect of the spring can often be unpredictable. On the one hand where the pneumatic spring is sufficiently energised, the table may move upwardly with an unexpected jerky motion. Additionally, lowering the table will require exertion on the part of the user. This may at times be difficult, especially where the user cannot position himself immediately adjacent to the table. On the other hand, pneumatic springs have a tendency to leak over time. When released, the table top may suddenly drop. On the other hand, if the user intends to raise the table top then the user may have difficulty in doing so with an ineffective pneumatic spring. Furthermore, pneumatic tables also have a tendency after a while to jam or stick creating further difficulties for the user.

It is known to provide table tops which are height adjustable. Such table tops have a dependent threaded spindle which is threadingly received within an internally threaded nut provided on a stationery base member. It is impractical in many situations to rotate a table top in order to selectively raise or lower the height of the table top. This is especially so where the table top is used to support a computer monitor with associated cables.

Accordingly, it is an object of the present invention to provide a height adjustable table assembly which overcomes or at least addresses some of the foregoing disadvantages.

SUMMARY OF THE INVENTION

In accordance with a first aspect of the present invention there is provided a height adjustable table assembly comprising: a table top having an upper surface and an outer periphery; a supporting base; and a height adjustment mechanism to selectively raise or lower the table top relative to the supporting base, the height adjustment mechanism including a height adjustment actuator in the form of a rotatable member which is selectively rotatable relative to the supporting base to actuate the height adjustment mechanism to selectively raise or lower the table top, the rotatable member being disposed underneath the upper surface of the table top and having an outer edge which terminates at or near the outer periphery of the table top for at least a portion of the outer periphery of the table top.

Preferably, the outer edge of the rotatable member is commensurate with the outer periphery of the table top or at least is closely spaced therefrom. In this manner the rotatable member operates as a hand wheel. Alternatively, where the outer edge of the rotatable member is substantially aligned with the table top for only a portion of the outer periphery of the table top, then it is preferred that said portion extends for a sector of the table top eg. 90 to 180 degrees. Suitably in any combination table arrangement incorporating the table assembly of the present invention with additional work surfaces, that sector is facing the user for ease of use.

Suitably, where the outer edge of the rotatable member terminates at or near the outer periphery of the table top then the outer edge of the rotatable member should be within reach of the user's hand positioned at the outer periphery of the table top. This enables the user to easily rotate the rotatable member without having to excessively reach to operate the height adjustment mechanism.

In a most preferred form of the invention, the outer edge of the rotatable member and the outer periphery of the table top are both circular with their central axes aligned. However the arrangement is not limited to both parts being circular and other variations on this theme include one or both parts being polygonal with say, six or more sides. For example, the table top might be circular with an octagonal rotatable member. On the other hand, the rotatable member might be circular with an heptagonal table top. Where the outer edge of the rotatable member is made circular then it may be in the form of a circular member or alternatively in the form of an annular member. Advantageously, the rotatable member is thin and substantially planar and is closely spaced underneath the table top so as to be unobtrusive. A gripping surface such as spaced indentations may also be provided on the side and/or the underside of the rotatable member to further increase ease of use. As a possible variation, the rotatable member could even be located within the table top, provided that the outer edge of the rotatable member is accessible to the user through apertures in the side of the table top.

In the invention broadly described above, the table assembly may have more than one leg. Accordingly, the height adjustment mechanism may be provided within one leg of the table, the bottom of which acts as the supporting base. The height adjustment mechanism may include a threaded spindle which is attached to the rotatable member to thereby rotate with the rotatable member. Thus the rotatable member and the threaded spindle constitute the rotatable portions of the height adjustment mechanism. The height adjustment mechanism may further include an internally threaded nut which is fixedly mounted relative to the supporting base of said leg of the table. The threaded spindle engages in the internally threaded nut.

The internal workings of the height adjustment mechanism may be shrouded within upper and lower shrouds telescopically received one within the other. Likewise, the other legs may constitute upper and lower portions, one telescopically received within the other.

Concerning the upper shroud surrounding the height adjustment mechanism, this is preferably a cylindrical tube. Potentially, the upper shroud could rotate with the rotatable portions of the height adjustment mechanism. However, it is preferred that the upper shroud is independent of the rotational movement of the rotatable portions of the height adjustment mechanism. However it will be understood that the upper shroud moves up and down with any movement of the height adjustable table top to hide the internal workings of the height adjustment mechanism. The upper shroud may be fixed against rotational movement relative to the lower shroud. For example, guides might be provided to guide the up and down movement of the upper shroud relative to the lower shroud and thereby prevent rotation. On the other hand, an amount of rotational movement may be provided between the upper shroud and the lower shroud, this rotational movement being independent of the rotational movement of the rotatable portions of the height adjustment mechanism. This independent rotational movement may be braked, for example by providing a friction imparting device between the upper and lower shroud. The friction imparting device might be in the form of an O-ring. The additional benefit of an O-ring over another type of friction imparting device is that an O-ring will roll up and down as the upper shroud moves up and down relative to the lower shroud.

Similarly, the lower shroud advantageously comprises a cylindrical tube. The lower shroud is suitably fixed to the supporting base of the leg. In the most preferred form of the invention, the upper shroud is an inner shroud which is received within an outer shroud which is the lower shroud. However the invention is not limited to this arrangement.

As stated above, the height adjustment mechanism may be provided within one leg of a table. Preferably, the table is of the type having a single generally central support leg. In such an arrangement the outer edge of the rotatable member may be adjacent to the outer periphery of the table top about substantially the entirety of the outer periphery. This works best with a circular table top and an annular rotatable member attached to the spindle.

As set out above, the rotatable member is on the underside of the table top and preferably closely spaced to the table top. Consequently, the outer edge of the rotatable member may be flush with the outer periphery of the table top. Where the outer periphery of the table top has an inclined edge then the outer edge of the rotatable member may be similarly inclined. For example, the outer periphery of the table top may have a bevelled edge at a particular angle. The rotatable member may also have a generally bevelled edge at the same angle. Desirably, the bevel on the rotatable member substantially lines up with the bevel on the table top.

As mentioned, the rotatable member is rotatable relative to the table top. As such, the table top may be supported on the rotatable member. This is effectively achieved through the use of bearings to allow the rotatable member to rotate relative to the table top. A substantially planar circular bearing race is preferred. In this preferred form of the invention, there is preferably a device for limiting free rotation of the table top. This may be in the form of a tether to connect the table top to a lower portion of the table assembly other than rotatable portions of the height adjustment mechanism. For example, the table top may be tethered to either the upper or lower shroud. Preferably the table top is tethered to the upper shroud.

The tether may be in the form of a curved or bent rod or bar. Preferably, this curved or bent rod or bar has sufficient flexibility that in the event a user knocks his hand against the tether whilst operating the height adjustment mechanism, the tether will move away so the user does not hurt his hand. The tether will then return to its former position. If the upper shroud is able to rotate independently relative to the rotatable portions of the height adjustment mechanism then any larger force will allow the table top to turn against the resistance imparted by the friction imparting device (eg. O-ring). Thus, if the table top is unintentionally bumped it will return to its former position. However, if it is intended to rotate the table top then this can be achieved by applying a force merely sufficient to overcome the frictional resistance imparted by the O-ring.

In a preferred form of the invention, the height adjustment mechanism also includes an internal spring which upwardly biases the linearly moveable parts of the table assembly. This will assist in counteracting gravity when the user elects to raise the table top.

In accordance with a second aspect of the present invention there is provided a table assembly comprising: a table top; a support assembly for the table top, including a supporting base, the table top being rotatable relative to the supporting base; and a resiliently deformable tether interconnecting the table top and at least a portion of the support assembly.

The resiliently deformable tether may be in the form of a spring arm. The spring arm may comprise a bent or curved rod or bar. The bent rod or bar may be bent back on itself thereby defining two arms, one of which is connected to the table top and the other of which is connected to said portion of the support assembly. The arm connected to the table top may be inserted into the table top through the side thereof.

The table may be of the type which is height adjustable, hence the reason for the rotatable top. However this aspect of the invention is not limited to a height adjustable table and may be applicable to any table which is rotatable for any purpose. The table top may rest on bearings.

If the table is height adjustable then the support assembly may include a telescopic leg assembly having two telescopically cooperating members. A first of these members may comprise said portion of the support assembly to which the resiliently deformable tether is connected. A second one of the members may comprise the supporting base or may be fixedly connected thereto.

It is possible for the two telescopic members to rotate relative to one another. However, if the table top is to be stabilised by being tethered to one of the telescopic members then preferably there is a brake to resist relative rotational motion. Such a brake may be in the form of a friction imparting device placed between the two telescopic members. The friction imparting device may be in the form of an O-ring.

If the table is a height adjustable table then the height adjustment mechanism, at least in part, may be shrouded by the telescopic leg assembly. As will be appreciated, the second aspect of the invention is best implemented in a table with a single central leg assembly as the support assembly.

In accordance with a third aspect of the present invention there is provided a supporting leg assembly for a table, the leg assembly comprising first and second telescoping members wherein one of the telescoping members is rotatable relative to the other, there being an O-ring fitted between the first and second telescoping members.

Preferably, the supporting leg assembly is embodied in a table and most preferably this table is a height adjustable table with only a single central supporting leg assembly.

The two telescoping members may comprise shrouds surrounding at least part of the height adjustment mechanism. Preferably, the upper telescopic member moves with the table top and the lower telescopic member forms part of the supporting base of the table or rather is fixed to the supporting base. Any of the features described in the first two aspects above may be incorporated into the supporting leg assembly according to the third aspect of the present invention.

BRIEF SUMMARY OF THE DRAWINGS

In order that the invention may be more fully understood, one embodiment will now be described by way of example with reference to the drawings in which.

DETAILED DESCRIPTION OF PREFERRED EMBODIMENTS

Figure 1:
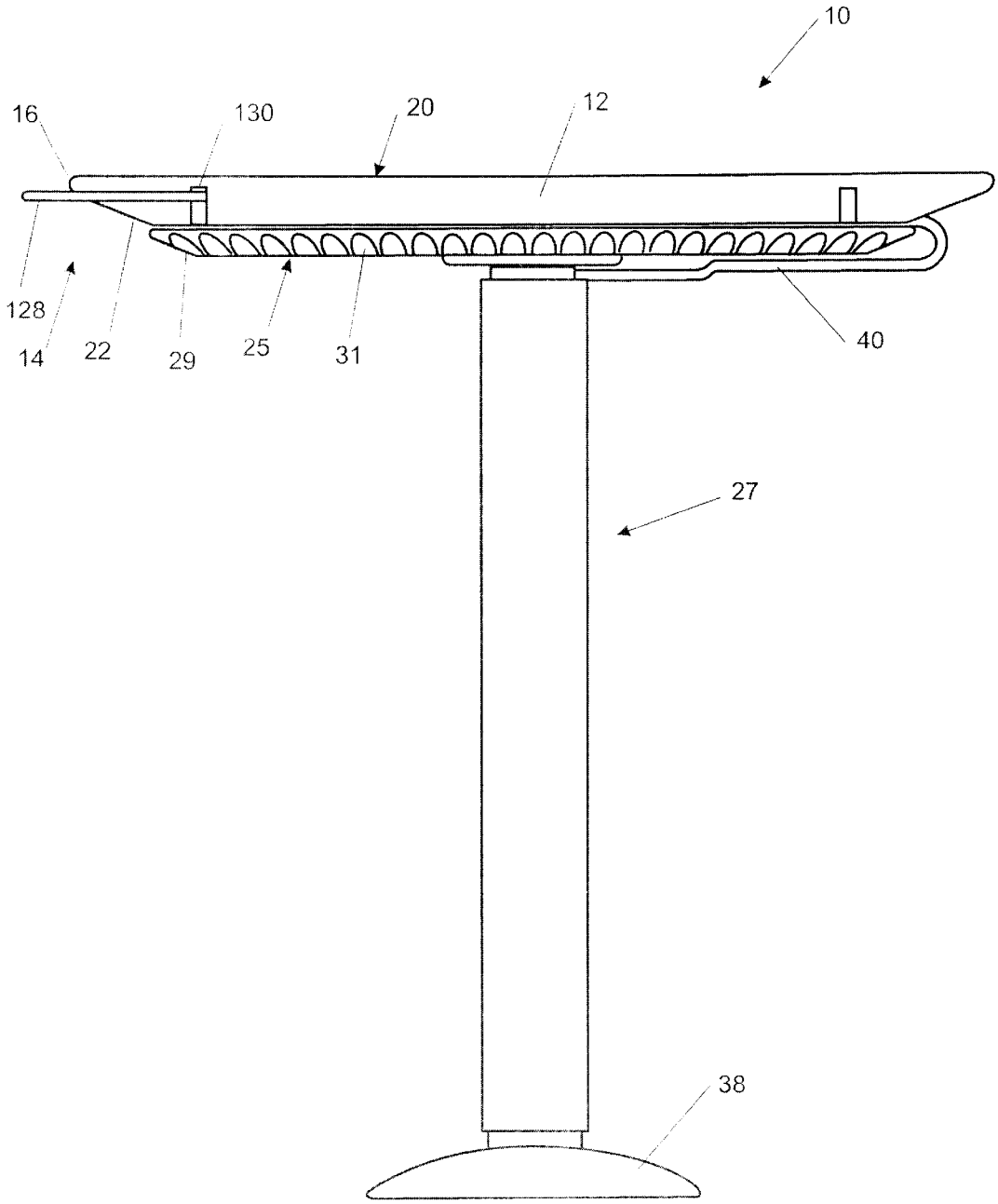
FIG. 1 is a side view of a height adjustable table assembly in accordance with a preferred embodiment of the present invention, the table assembly being depicted in a lowered position.
Figure 9:
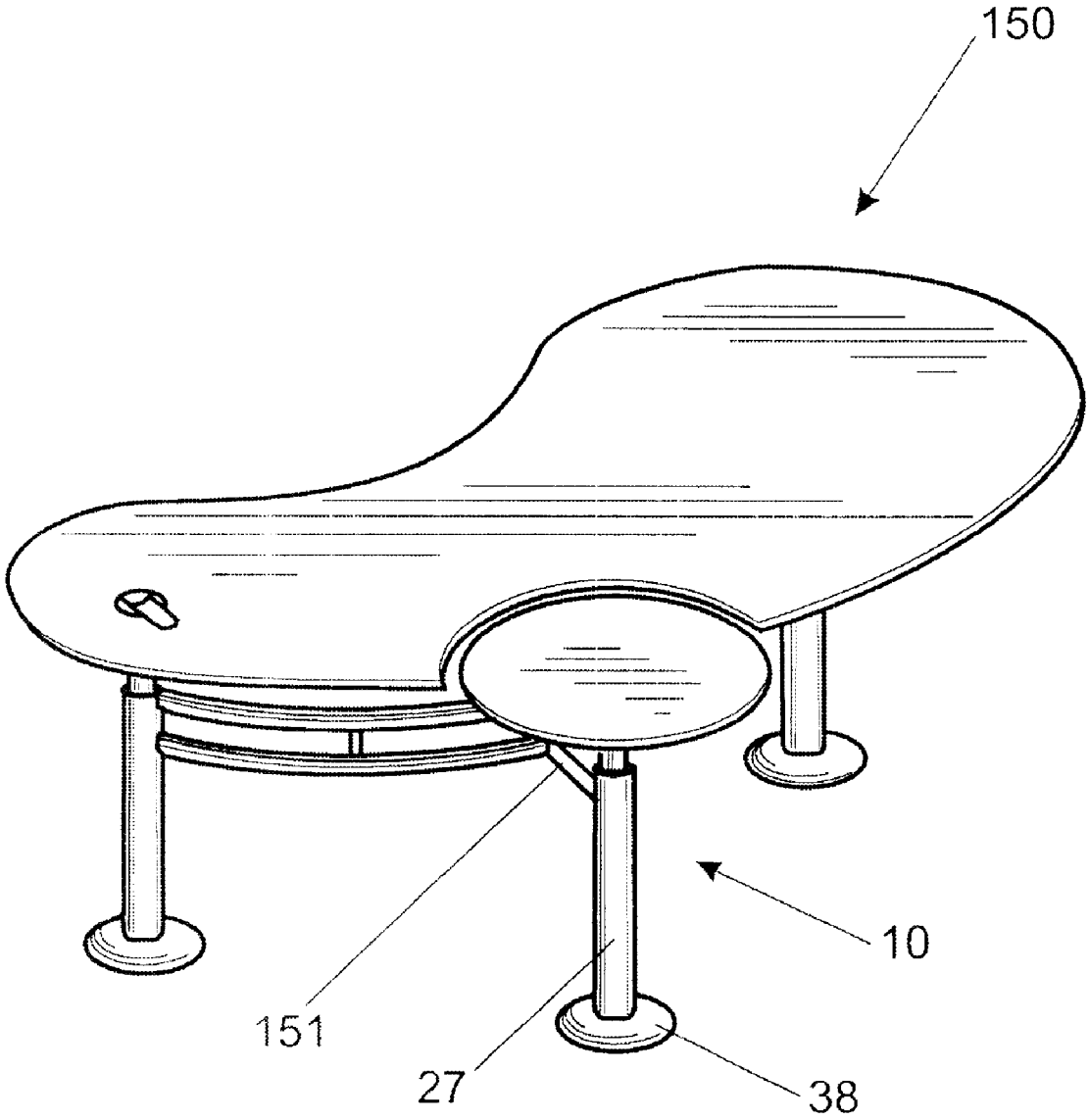
FIG. 9 is a perspective view of a combination table assembly incorporating the height adjustable table assembly of FIG. 1.
Figure 10:
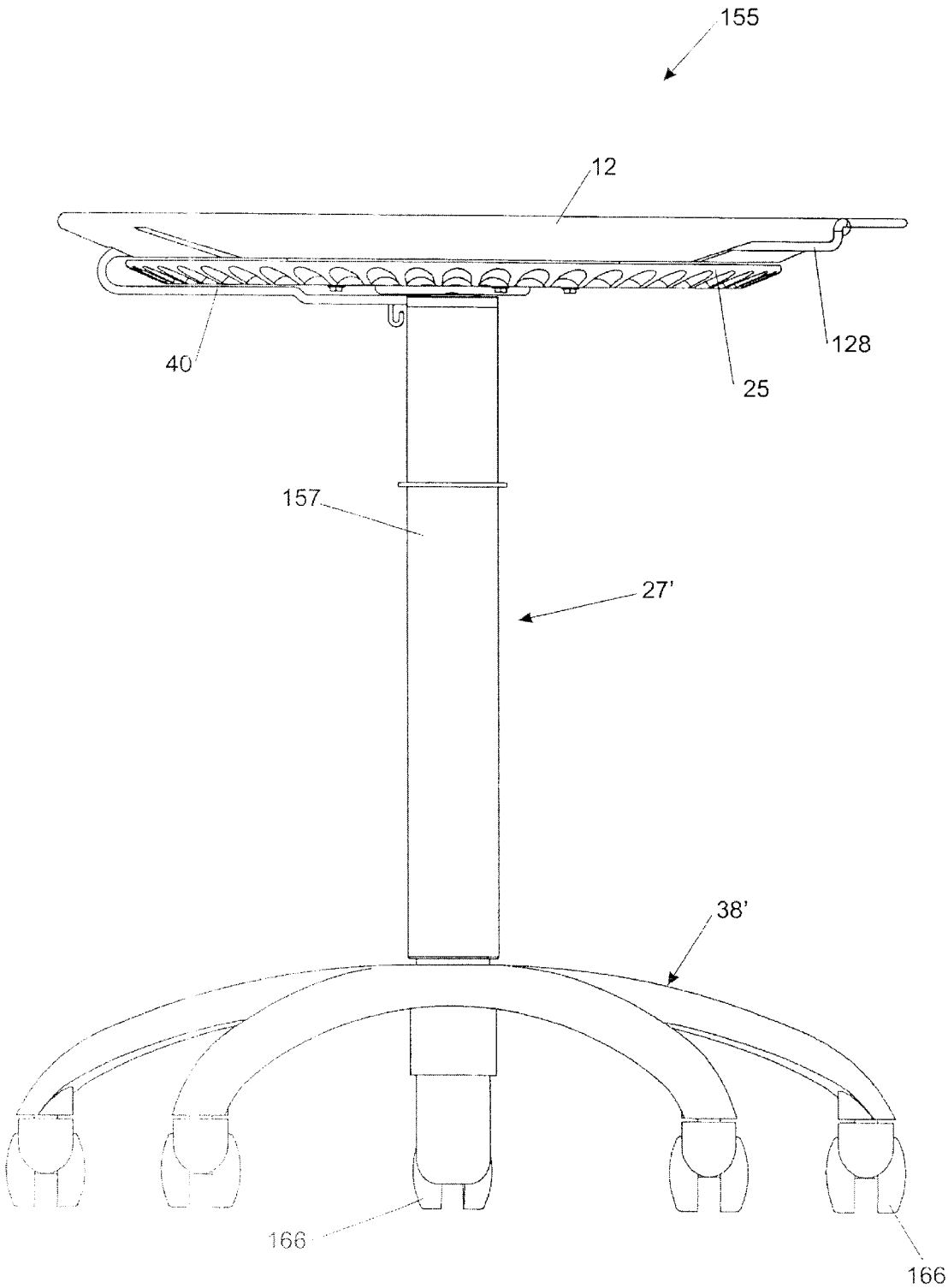
FIG. 10 is a side view of a height adjustable table assembly in accordance with a second preferred embodiment of the present invention.
Figure 11:
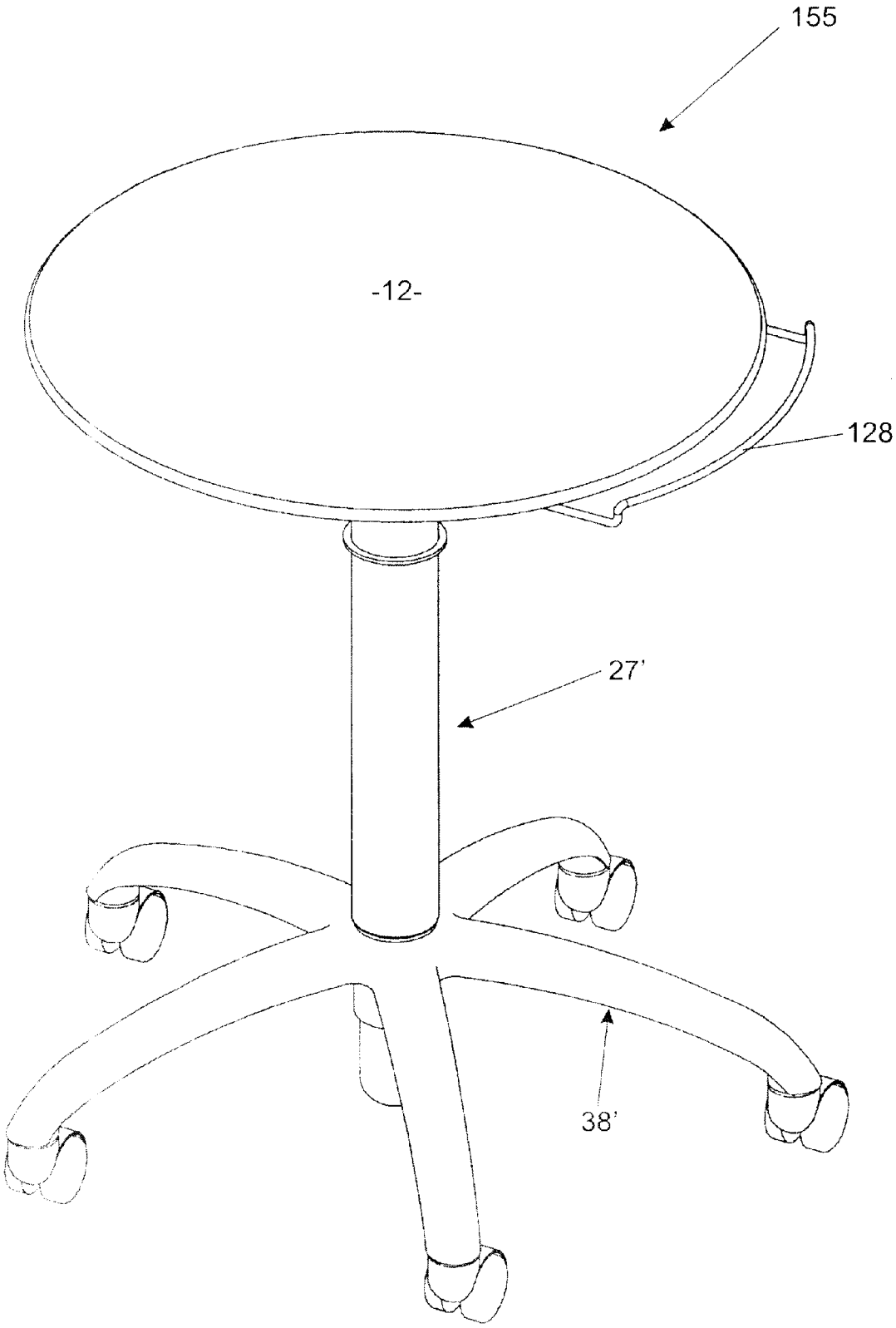
FIG. 11 is a perspective view of the table assembly illustrated in FIG. 10.

FIG. 1 illustrates the basic parts of the height adjustable table assembly 10. The assembly 10 is specifically intended to form part of a combination table assembly as shown in FIG. 9. For a free-standing table assembly the reader is directed to FIGS. 10 to 15. The height adjustable table assembly 10 comprises a table top 12 which is circular in plan view. The table top 12 has an outer periphery 14 having the contour as illustrated. The uppermost part 16 of the outer periphery 14 is radiused between the upper surface 20 of the table top and a bevelled portion 22. The bevelled portion 22 of the outer periphery 14 slopes downwardly and inwardly as illustrated.

Underneath the table top 12 is an actuator for a height adjustment mechanism. The actuator is in the form of a rotatable member 25. The rotatable member 25 is rotatable about the central axis of the table assembly which is through the centre of the circular table top 12 and the support assembly 27. As can be seen from FIGS. 6 and 7, the rotatable member 25 is a plate-like, relatively planar, annulus of constant radial cross-section. The rotatable member 25 also has a downwardly and inwardly inclined bevelled contour at its outer edge 29 as illustrated. This bevelled contour 29 generally lines up with the bevelled portion 22 although the bevelled contour 29 slightly protrudes from the bevelled portion 22 so that the user with his hand at the outer periphery 14 can easily engage the outer edge 29 of the rotatable member 25. Additionally, spaced, dished grooves 31 having an arch-shaped outline are provided at the outer edge 29 of the rotatable member 25 to facilitate turning of the rotatable member 25 to effect height adjustment of the table top 12 in a manner which will be explained. The table top 12 and the height adjustment actuator in the form of rotatable member 25 is supported by a support assembly generally indicated by numeral 27.

Figure 2:
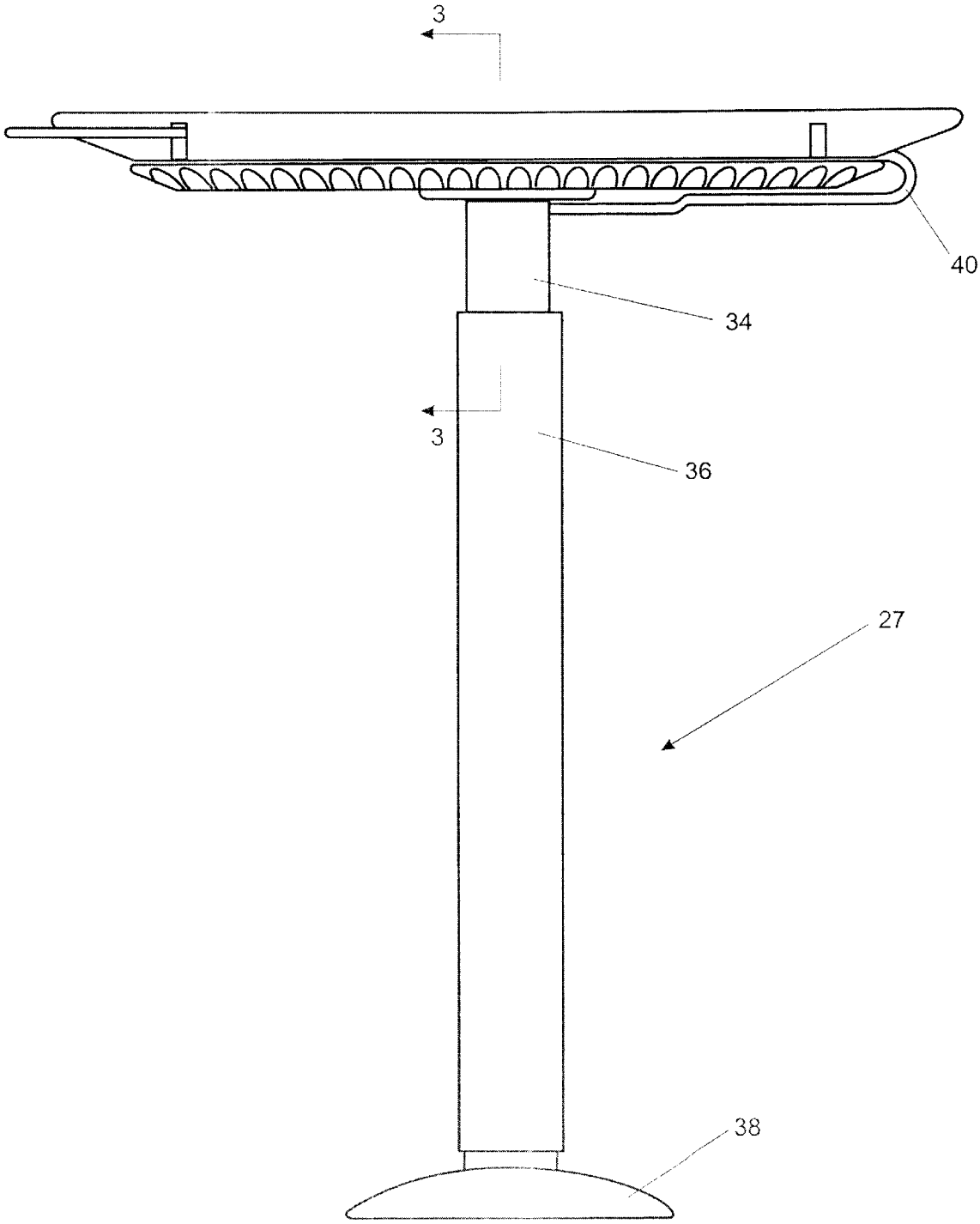
FIG. 2 is a side view of the height adjustable table assembly of FIG. 1 except shown in an elevate position.

As can be seen in FIG. 2, the support assembly 27 includes telescoping leg members constituted by upper (inner) shroud 34 and lower (outer) shroud 36. These shrouds 34, 36 hide at least part of the internal workings of the height adjustment mechanism. The shrouds 34, 36 comprise metal cylindrical tubes. The lower shroud 36 is mounted to a supporting base 38. It can be seen from a comparison of FIGS. 1 and 2 that in FIG. 1, the table top 12 is in a lowered position in which the upper shroud 34 is almost wholly received within the lower shroud 36. In FIG. 2, the upper shroud 34 extends partially out of the lower shroud 36.

FIGS. 1 and 2 also show a resiliently deformable tether 40 which interconnects the table top 12 with the upper shroud 34. The resiliently deformable tether is in the form of a metal spring bar which will be explained in further detail in connection with FIG. 6.

Figure 3:
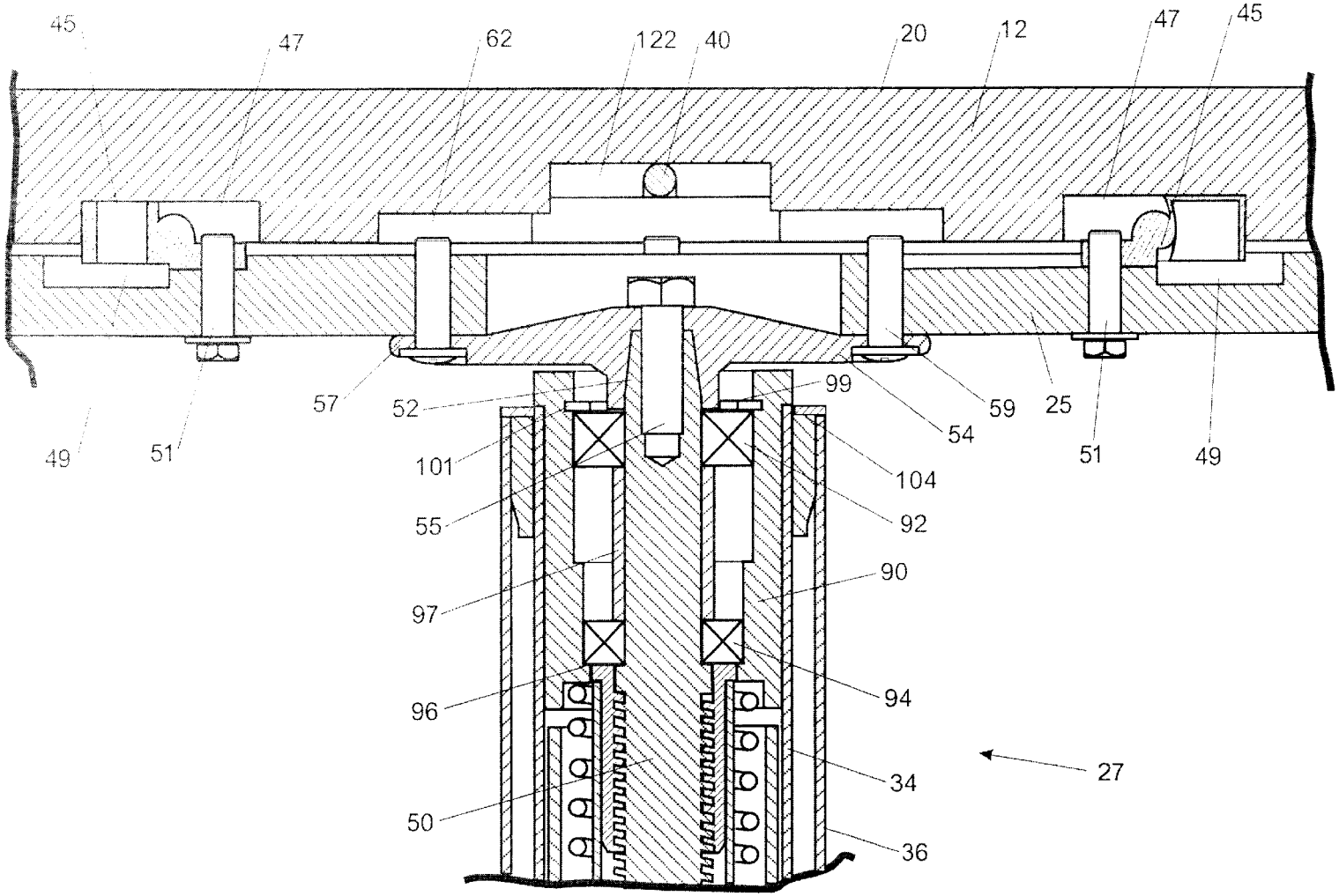
FIG. 3 is a sectional view of the table assembly through 3—3 of FIG. 2, showing the junction between the table top and the central supporting assembly.

In FIG. 3, the table top 12 and the rotatable member 25 can be seen in part. A circular bearing race 45 depicted on opposite sides of FIG. 3 is mounted between the table top 12 and the rotatable member 25. The bearing race 45 is a ball-bearing type race which is circular and substantially planar so that the thickness of the table top 12 and the rotatable member 25 does not have to be too great to accommodate the thickness of the bearing race 45. As can be seen, the bearing race 45 is accommodated within a circular recess 47 made on the underside of the table top 12 and a circular recess 49 made in the upper surface of rotatable member 25. The circular bearing race 45 is fixed to the rotatable member 25 by screws 51. The bearing race 45 is also fixed to the table top by screws (not shown). The table top 12 is supported by the bearing race 45 and thus the rotatable member 25 and the table top 12 are able to rotate relative to one another.

Within support assembly 27 is an externally threaded spindle 50. The spindle 50 has a tapered upper end 52 which is inserted into a correspondingly shaped recess provided on the underside of rotatable top plate 54. The top plate 54 and the threaded spindle 50 are interconnected via a set screw 55 which is received into an internally threaded recess provided at the top end 52 of the spindle 50 through a threaded aperture in the top plate 54.

The top plate 54 is circular with a constant radial cross section which tapers to a peripheral flange 57. The peripheral flange engages with the underside of the rotatable member 25. The rotatable member 25 and the top plate are bolted together with screws of the type known as a "euro-screw" 59. The underside of the table top 12 has a circular recess 62 machined therein to prevent the ends of screws 59 interfering with the table top 12.

Figure 4:
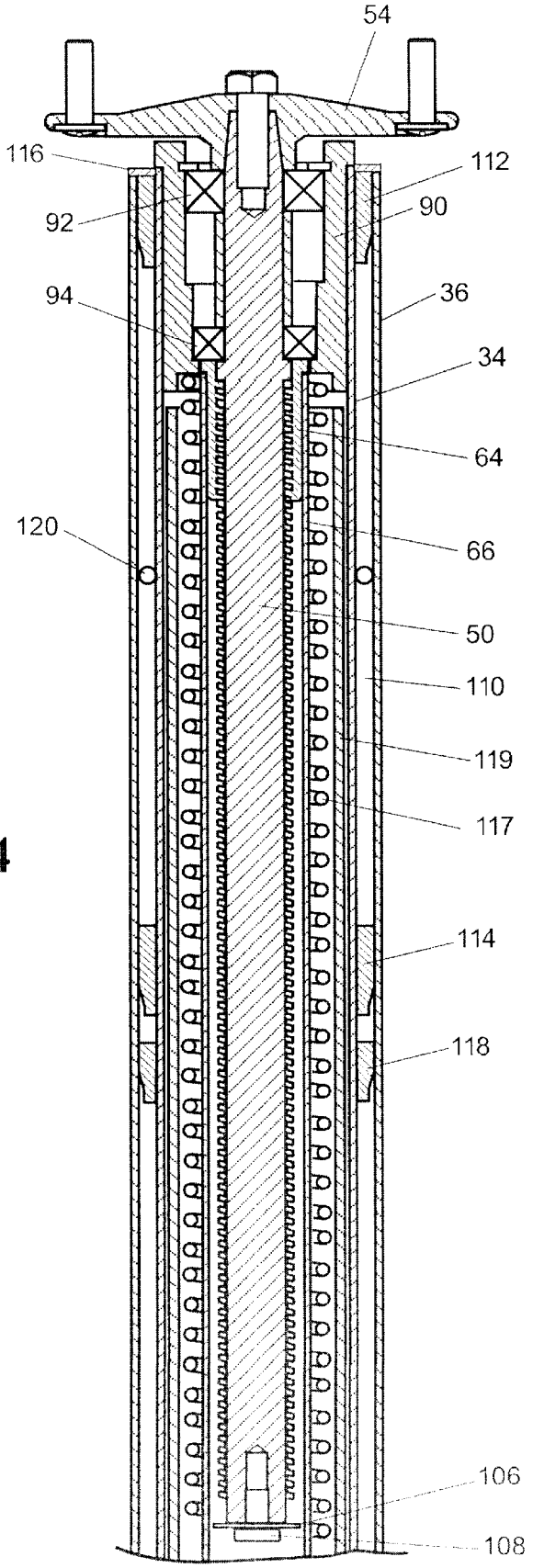
FIG. 4 is a sectional view illustrating an upper part of the supporting assembly.
Figure 5:
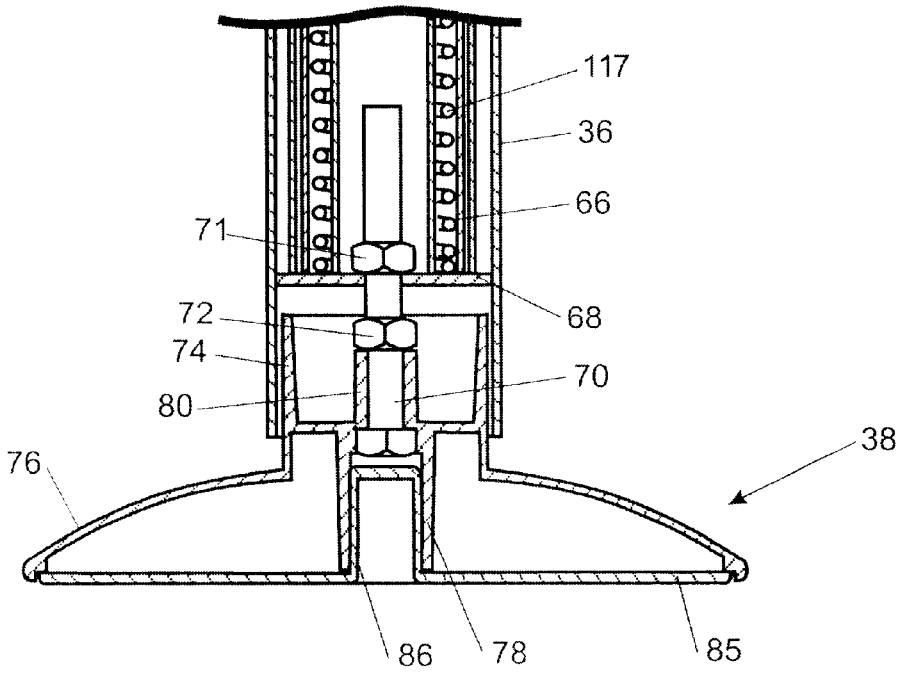
FIG. 5 is a part sectional view illustrating a lower part of the supporting assembly shown in FIG. 4 together with a supporting base.

Referring to FIG. 4, a substantial portion of the support assembly can be seen. The threaded spindle 50 engages within an internally threaded plastic spindle nut 64. The spindle nut 64 is glued and press-fitted into internal support tube 66. As shown in FIG. 5 the internal support tube 66 extends down to be welded to a base washer plate 68. Prior to welding of the support tube 66 and the base washer plate 68, a hexagonal head nut 71 is welded to the base washer plate. The final welding step is between the lower shroud 36 and the base washer plate 68.

Figure 8:
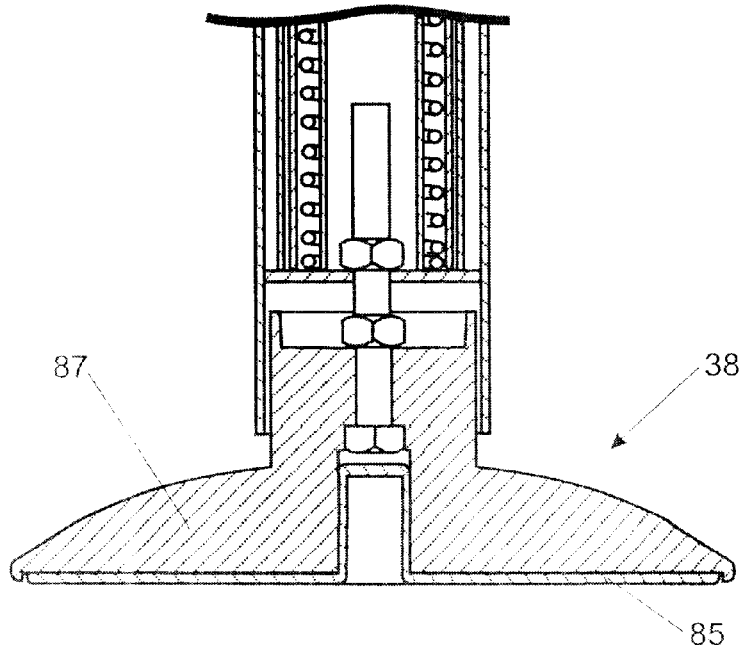
FIG. 8 is a part sectional view illustrating a lower part of the supporting assembly as in FIG. 5 but from a transverse perspective.

The supporting base 38 is a cast metal member having strengthening partitions as shown in FIG. 8 and having an upwardly extending cup portion 74 and an outwardly extending flange portion 76. A dependent tube portion 78 extends downwardly to the same level as the outwardly extending flange portion 76. A further upwardly extending tube portion 80 is also provided. The head of a hexagonal head bolt 70 is held against rotation in a correspondingly shaped recess defined at the top of the dependent tube portion 78. The hexagonal nut 72 is screwed down until it engages with the top of upwardly extending tubular portion 80. Then the leg assembly described in the foregoing paragraph is screwed down with the nut 71 engaging with threaded bolt 70. A range of positions is allowed. When the table assembly is incorporated into a combination table assembly of the type shown in FIG. 9 having three legs, this provides a height adjustment feature of up to 30 mm to accommodate uneven floors.

Fitted into the underside of the supporting base 38 is a plastic glide member 85 made of low friction ABS plastic. The plastic glide member 85 is circular in plan with a central upwardly extending cylindrical boss 86 receivable within the dependent tube portion 78 to hold the plastic glide member in place. The plastic glide member is generally in the shape of a plastic disc which at its outer edge fits within the outwardly extending flange portion 76. The plastic glide member 85 will enable the desk to be slid easily over floors and also minimise scratching of hard floors.

The net result is that the spindle nut 64 via the internal support tube 66 is fixed relative to the supporting base 38. Hence, as the rotatable member 25 is rotated along with top plate 54 and spindle 50, the net result will be that these rotatable portions will have a net increase or decrease in height, depending upon the direction of rotation. As the table top 12 is supported by the rotatable member 25 there will be a net increase or decrease in the height of the table top. Moreover, the inner shroud 34 is carried by these rotatable portions so that the inner shroud 34 will move up and down, in and out of the outer shroud 36 with the height adjustment of the table top. The inner and outer shrouds 34, 36 also act as guides to prevent the table top 12 from tilting or wobbling.

The thread on the spindle and the corresponding nut 64 is of the multi-start type with 2 or 3 starts. This gives a high degree of height adjustment per rotation of the rotatable member 25. With a 2 start, a 9 mm height adjustment is achieved per revolution of the rotatable member 25.

The inner shroud 34 is carried by the rotatable portions in a manner as will now be described. Reverting to FIG. 3 for greater clarity, an annular bearing assembly is mounted around the upper part of spindle 50. The annular bearing assembly includes annular bearing housing 90, housing two annular bearings 92 and 94. The lower bearing 94 engages against annular shoulder 96 in the bearing housing 90. An annular spacer 97 is inserted between the upper bearing 92 and the lower bearing 94. A circlip 99 engages within internal annular notch 101 machined into the bearing housing 90.

The bearing housing 90 also includes an external annular shoulder 104. The bearing housing 90 is press fitted into the upper end of the inner shroud 34 until the top end of the shroud engages against the annular shoulder 104.

Reverting to FIG. 4, it will be appreciated that as the rotatable member 25 and the spindle 50 rotate so as to increase the height of the table top 20, the inner shroud will be synchronously drawn out of the outer shroud 36. The lower end of the spindle 50 has a flat washer 106 attached thereto by screw 108. In increasing the height of the table top, the spindle 50 is progressively drawn out of the spindle nut 64, until the flat washer 106 eventually engages at the bottom of the spindle nut 64. This will provide a limit to the lineal movement of the spindle 50 and the inner shroud 34. It will be understood however that whilst the lineal movement of the inner shroud 34 is synchronised with the lineal movement of the spindle 50, rotational movement of the inner shroud 34 is independent of the rotational movement of the spindle 50 because of the bearings 92, 94.

It can be seen from FIG. 4 that there is an annular gap 110 provided between the inner shroud 34 and the outer shroud 36. Upper and lower annular steel bushes 112, 114 are inserted into the gap therebetween to maintain constant spacing between the two shrouds. The location of the lower bush is such that with the spindle 50 in its most extended position with the washer 106 engaging against spindle nut 64, both of the annular bushes 112, 114 will be disposed between the inner shroud 34 and the outer shroud 36.

Thus the upper and lower shrouds 34, 36 also act to hold the table top 12 against tilting. A force applied to the edge of table top 12 will be transmitted down through rotatable member 25, top plate 54, spindle 50, through bearings to bearing housing 90, to inner shroud 34 to outer shroud 36, bushes 112, 114. This restrains the table top against tilting and wobbly movements as well as insuring against jamming of the threads of the spindle 50 and nut 64.

The outer shroud 36 is provided with an upper inwardly extending top plate 116. The outer shroud 36 will be powder-coated. Accordingly, since the annular bushes 112, 114 are press fitted into the outer shroud 36, it is necessary for the outer shroud 36 to be properly sized before the powder-coating process. Otherwise, if the outer shroud 36 is distorted too much then the powder-coated paint surface will crack. Accordingly, a sizing bush 118 is inserted into the outer shroud 36 in order to properly size it so that the powder coating paint finish does not crack when the annular bushes 112 and 114 are inserted therein. An ultra-height molecular weight polyethylene tape is provided between the annular bushes 112, 114 and the inner shroud 34 to reduce friction.

Referring to FIG. 5, the lower end of the outer shroud 36 is welded to the base washer plate 68. The outer shroud 36 is thus fixedly secured relative to the supporting base 38. As shown in FIG. 4, an O-ring 120 is inserted into the annular gap provided between the inner and outer shroud 34, 36 and the upper and lower bushes 112, 114. Since the outer shroud 36 is fixed relative to the supporting base 38, as the inner shroud 34 moves up and down, the O-ring 120 will roll within the annular gap. As has already been explained, the inner shroud 34 can rotate independently of the spindle 50 due to the presence of the bearing assembly. However, any rotational movement of the inner shroud 34 will be braked by the presence of the O-ring 120. A spring 117 in compression bears against the underside of the bearing housing 90 to counteract gravity. A plastic silencer tube 119 (a PVC extruded tube) keeps the spring 117 straight and reduces any noise made by the spring 117.

Figure 6:
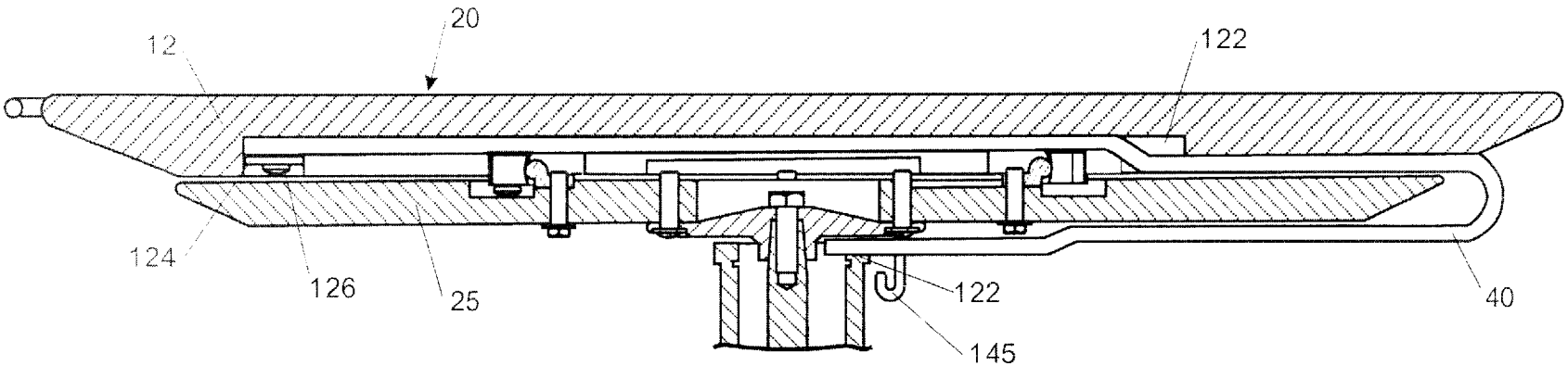
FIG. 6 is a sectional view through the table top of the table assembly illustrated in FIG. 1, shown from the perspective in FIG. 1.

As has already been mentioned in connection with FIG. 1, a resiliently deformable tether 40 in the form of a spring bar is provided. The spring bar 40 is shown in FIG. 6. The spring bar 40 interconnects the table top 12 with the bearing housing 90 to limit free rotation of the table top 12. Since the bearing housing 90 is connected to the inner shroud 34 whose rotation is braked relative to outer shroud 36 by O-ring 120, the table top 12 is thereby braked against free rotational movement.

More specifically, the spring bar 40 comprises a bent rod of circular cross section. The rod is bent back on itself to form two arms as illustrated in FIG. 6. The upper arm is inserted into the table top through a slot or recess 122 provided therein. The remote end of the upper arm is connected to the underside of the table top 12 by a lug 124 welded to upper arm and which extends transversely to the bar 40, with two screws 126 (only one of which is shown) securing opposite ends of the lug 124 to the underside of the table top 12. The lower arm is inserted into the top of the bearing housing 90 as shown through a slot provided therein. It will be understood that should somebody accidentally bump the table top it will not spin freely on its bearings nor will they hurt their hand. Rather, the table top 12 will rotate to a limited degree, dependent upon the flexibility of the resiliently deformable spring bar 40. The spring bar 40 will then return the table top 12 to its original position. If a force greater than the frictional force is applied to the table top 12, such as when a user intends to rotate the table top, then the table top 12 will rotate deflecting the spring bar 40 and thereafter, the inner shroud will be allowed to rotate relative to the outer shroud 36 and thus the table top 12 will be permitted to rotate independently of the action of the height adjustment actuator 25.

Figure 7:
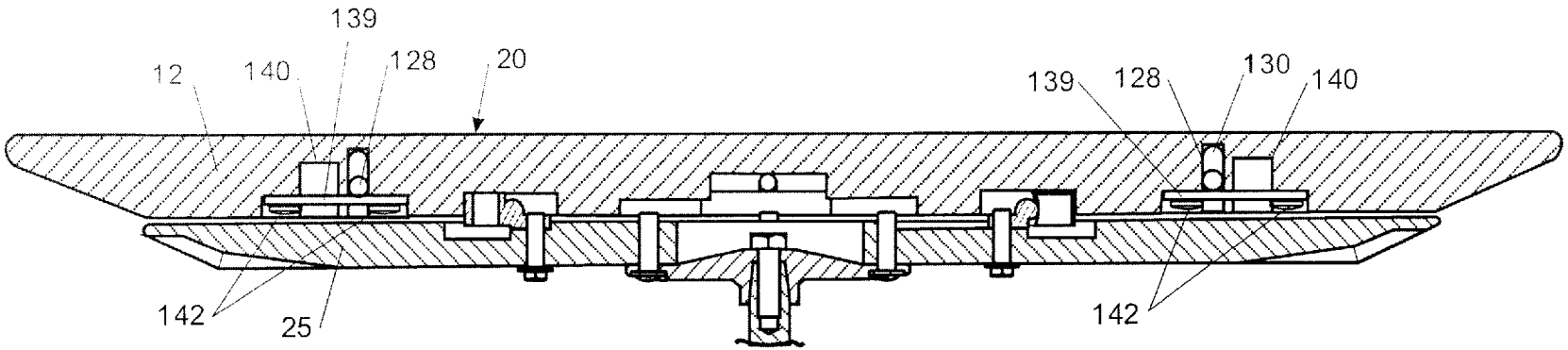
FIG. 7 is an extended view of FIG. 3 illustrating the table top in section with the upper part of the support assembly removed for clarity.
Figure 15:
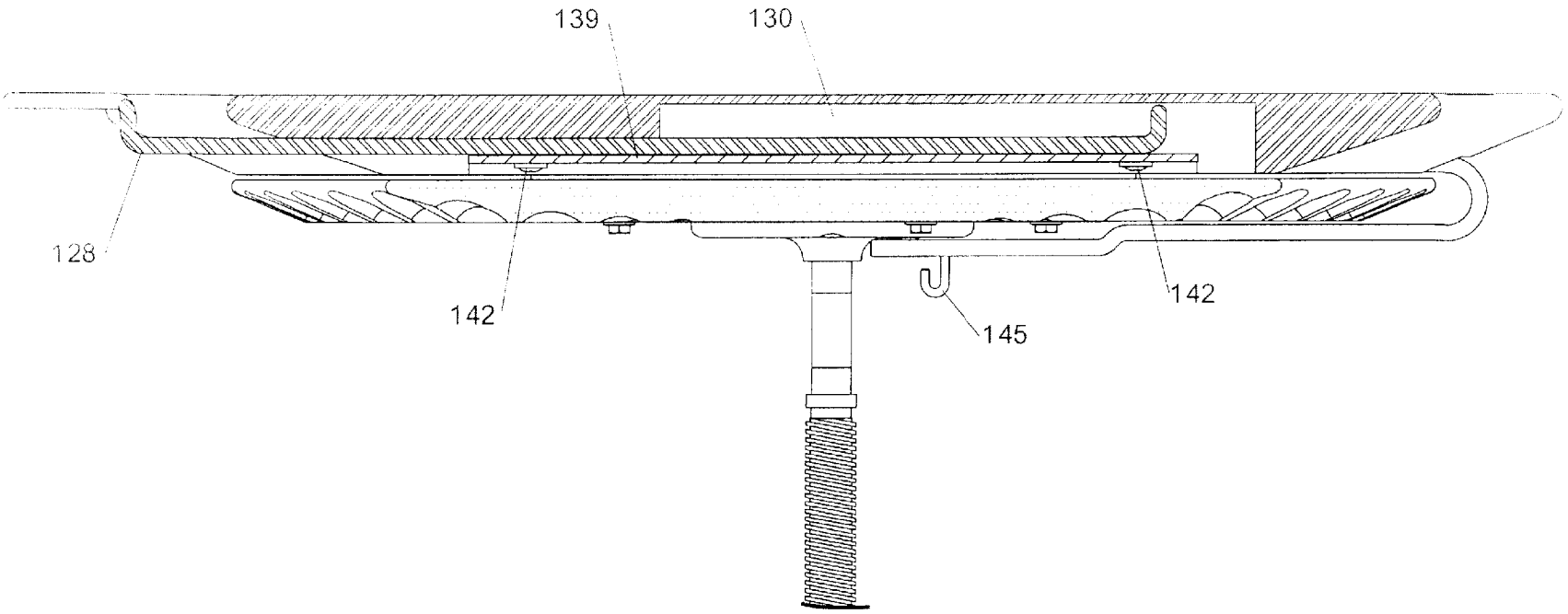
FIG. 15 is a part sectional view providing further detail of the keyboard holder.

FIGS. 6 and 7 also illustrate some accessories provided on the height adjustable table assembly. Firstly, a keyboard holder 128 is provided in the form of a bar of circular cross section which is arranged in a general U-shape. The two ends of the U-shape are inserted into slots 130 machined into the underside of the table top 12. The keyboard holder 128 can also been seen in FIGS. 1 and 2. The arms and the base of the U shaped keyboard holder 128 are shaped to support a keyboard. The keyboard holder 128 is slidable into and away from table top 12. Additional slots 140 machined in the underside of the table top 12 extend out the side of the table top 12 in the opposite direction. The slots 140 may provide a mounting for other optional accessories such as a screen or computer related articles such as power boards, cable holders etc. Retainers 139 with screws 142 holds the keyboard holder 128 and the other optional mounting within the slots 130. FIG. 15 also illustrates in further detail, the keyboard holder 128.

Furthermore, in FIG. 6 can be seen a safety chain hook 145. A safety chain (not shown) can be connected between the hook 145 and the monitor (not shown) positioned on table top 12.

FIG. 9 also illustrates a combination table assembly 150 incorporating the height adjustable table assembly 10. It can be seen that the support assembly 27 of the table assembly 10 defines one leg of the combination table assembly 150. The table assembly 10 is connected to the remainder of the combination table assembly 150 via stretcher 151 which is part of a stretcher assembly 152 extending between the three legs. The stretcher 151 is directly connected to the stationary outer shroud 36. FIG. 9 is illustrative only of the various configurations which can be achieved in combination table assemblies incorporating one or more of the table assemblies 10.

FIGS. 10 to 15 illustrate a second preferred form of a table assembly 155 which can operate as a free standing unit. The table assembly 155 has many parts which are substantially the same as the parts of the table assembly 10 depicted in FIGS. 1 to 9. Therefore, like parts will be represented by like reference numerals. Where the parts of the assembly 155 differ from their counterparts in the table assembly 10, those parts will be referenced by a prime (') following the reference number eg bearing housing 90'.

One of the main differences between the table assembly 155 and the table assembly 10 is that it is the outer shroud 157 instead of the inner shroud 34 which moves with the height adjustment of the table top 12. Accordingly, the bearing housing 90' is press fitted into the upper end of the outer shroud 157. The bearing housing 90' is thus of greater thickness compared to its counterpart 90 in the table assembly 10. The outer shroud 157 thus moves up and down with the height adjustment of the table top 12 but due to the presence of bearings 92, 94 the outer shroud 157 is not constrained to follow the rotational movement of the rotatable member 25.

Figure 14:
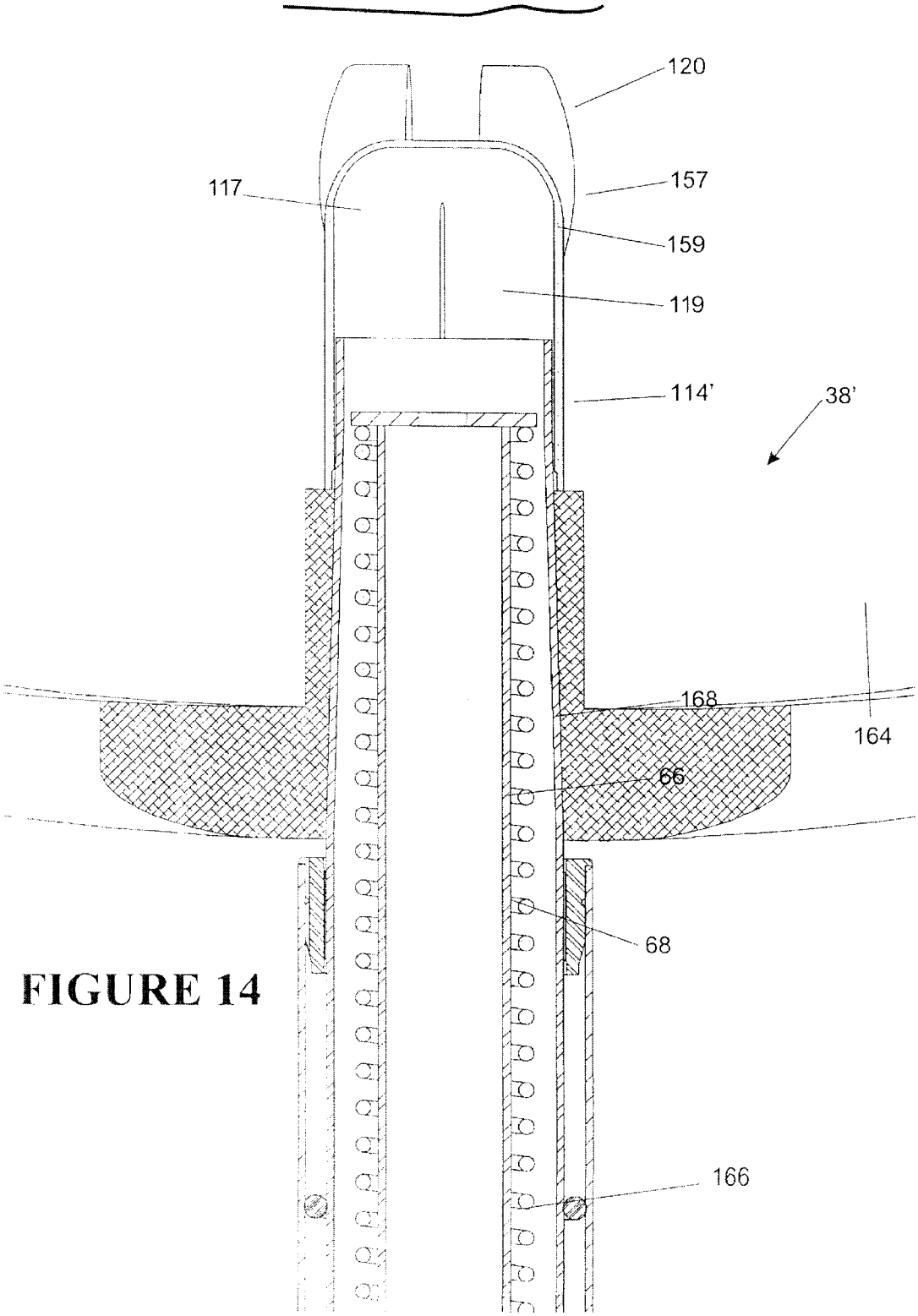
FIG. 14 is a sectional view illustrating a lower part of the central supporting assembly together with a portion of a supporting base.

As can be seen most clearly in FIG. 14, the inner shroud 159 has a tapered lower end. The inner shroud 159 is pressed to adopt an angle of taper, referred to as a "morse" taper as would be understood by those skilled in the art. The chair base 38' is in the form of a cast leg assembly having five equally radially spaced legs, each of which terminate in a castor 166 (see FIG. 10). Reverting to FIG. 14, the cast leg assembly 38' has a tapered bore 168 extending therethrough into which the tapered lower end of the inner shroud 159 is received. The taper on the inner bore 168 is the same as the morse taper on the inner shroud 159 and hence the inner shroud 159 is fixed in the internal bore 168 of the leg assembly 38'.

The lower end of the internal support tube 66 is also welded to base washer plate 68 as per the previous embodiment. While it is not clearly illustrated in FIG. 14, the base washer plate 68 is welded to the inner shroud 159 so that the internal support tube 66 is secured relative to the support base 38'.

It should be understood that the inner shroud 159 will thus remain stationary with the supporting base 38 as the table top 12 is adjusted in height, the outer shroud 157 moving up and down with the height adjustment of the table top 12.

Another difference is the arrangement of spacers 112' and 114'. Spacer 114' is press fitted into the lower end of outer shroud 157. Its orientation is reversed as compared with the embodiment in FIGS. 1 to 9. Upper spacer 112' is inserted part way along outer shroud 157 and is press fitted into outer shroud 157. The O-ring 120 is positioned between the two bushes 112' and 114'.

As with the previous embodiment, the spindle 50 will rotate within spindle nut 64. The lower end of the spindle 50 is provided with washer 106 and screw 108 as per the previous embodiment. However, the present embodiment also includes two bushes 162, stacked one above the other on top of washer 106. The top of the top bush 162 engages against the underside of the spindle nut 64 at the uppermost extent of the travel of table top 12. Hence, it will be appreciated that the table assembly 155 allows for slightly lesser extension of the table top 12 from the central supporting assembly compared to table assembly 10.

Figure 12:
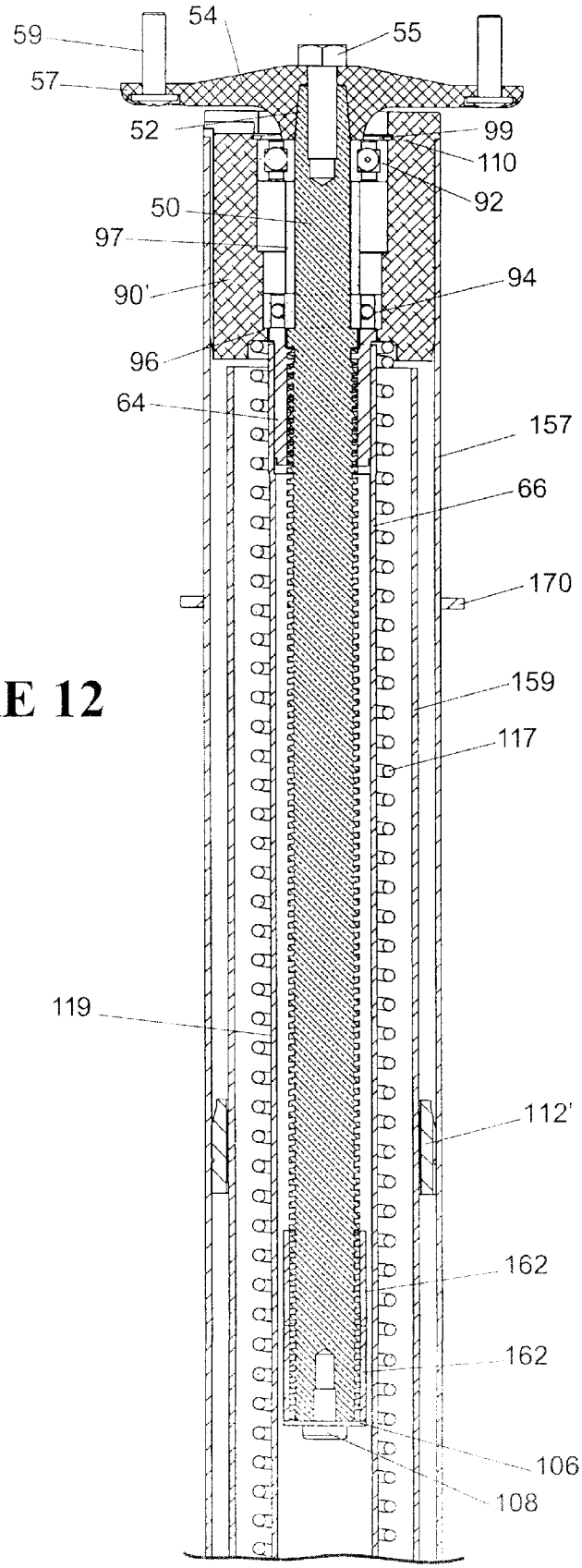
FIG. 12 is a sectional view illustrating an upper part of the central supporting assembly of the table assembly of FIG. 10.
Figure 13:
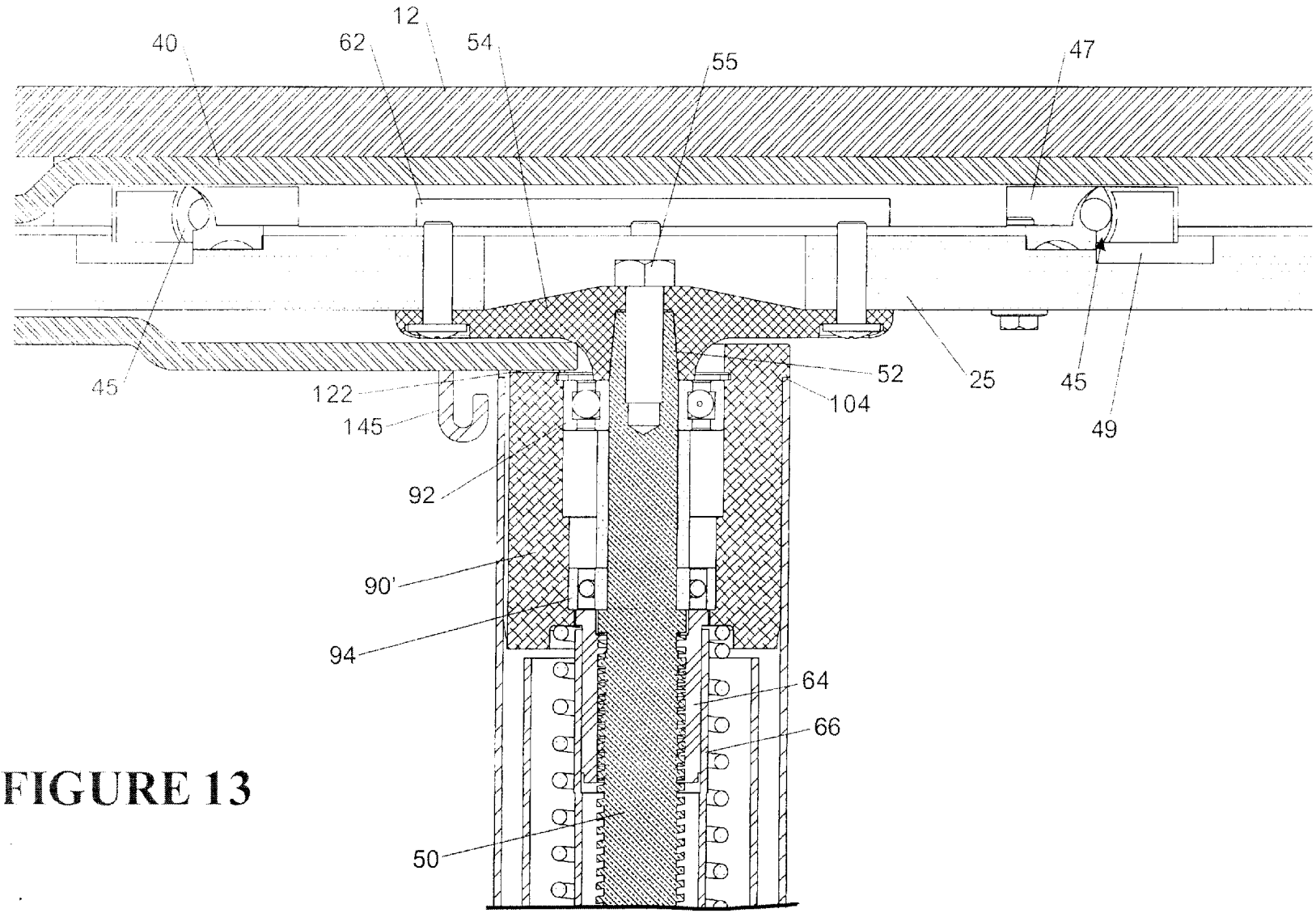
FIG. 13 is a sectional view of the table assembly shown from the perspective of FIG. 10, showing the junction between the table top and the central supporting assembly.

FIG. 12 also depicts an annular collar 170 which is welded onto the outer shroud 157. The purpose of the collar 170 is to support a complementary ring provided on an accessory which is able to be mounted on the table assembly 155. For example, the collar 170 may support a CPU holder which includes the complementary ring.

What is claimed is:

1. A height adjustable table assembly comprising:

a table top having an upper surface and an outer periphery;

a supporting base for the table top; and a height adjustment mechanism to selectively raise or lower the table top relative to the supporting base, the height adjustment mechanism including a height adjustment actuator in the form of a rotatable member which is selectively rotatable relative to the supporting base to actuate the height adjustment mechanism to selectively raise or lower the table top, the rotatable member being disposed underneath the upper surface of the table top and having an outer edge which terminates at or near the outer periphery of the table top for the entirety of the outer periphery of the table top.

2. The height adjustable table assembly as claimed in claim 1 wherein the outer edge of the rotatable member is within reach of a user's hand positioned at the outer periphery of the table top.

3. The height adjustable table assembly as claimed in claim 1 wherein the rotatable member and the table top have their central axes aligned.

4. The height adjustable table assembly as claimed in claim 3 wherein the table is of the type having a single generally central support leg with the table being circular and the rotatable member being annular.

5. The height adjustable table assembly as claimed in claim 3 wherein the outer edge of the rotatable member is generally flush with the outer periphery of the table top.

6. The height adjustable table assembly as claimed in claim 1 wherein the rotatable member is thin and of a generally planar configuration.

7. The height adjustable table assembly as claimed in claim 1 further comprising a gripping surface provided at the outer edge thereof.

8. The height adjustable table assembly as claimed in claim 1 wherein the height adjustment mechanism, at least in part, is provided within a leg of the table, the leg being connected to the supporting base.

9. The height adjustable table assembly as claimed in claim 8 wherein the height adjustment mechanism comprises: a threaded spindle which is attached to the rotatable member for rotation with the rotatable member; and an internally threaded nut which is fixedly attached relative to the supporting base, the threaded spindle engaging in the internally threaded nut.

10. The height adjustable table assembly as claimed in claim 9 wherein the leg comprises upper and lower shrouds telescopically received one within the other, the spindle and nut being shrouded within at least one of the upper and lower shrouds.

11. The height adjustable table assembly as claimed in claim 10 wherein the upper shroud is independent of the rotational movement of the rotatable member of the height adjustment mechanism but movable up and down with corresponding movement of the height adjustable table top.

12. The height adjustable table assembly as claimed in claim 11 wherein the upper shroud and the lower shroud are rotatable relative to one another, the lower shroud being fixed relative to the supporting base.

13. The height adjustable table assembly as claimed in claim 12 wherein the relative rotational movement between the upper shroud and the lower shroud is braked.

14. The height adjustable table assembly as claimed in claim 13 wherein the relative rotation movement is braked by a friction imparting device disposed between the upper and lower shrouds.

15. The height adjustable table assembly as claimed in claim 14 wherein the friction imparting device is in the form of an O-ring.

16. The height adjustable table assembly as claimed in claim 1 wherein at least part of the height adjustment mechanism is shrouded within upper and lower shrouds telescopically received one within the other.

17. The height adjustable table assembly as claimed in claim 1 wherein the table top is supported on the rotatable member through the use of bearings to allow the rotatable member to rotate relative to the table top.

18. The height adjustable table assembly as claimed in claim 1 wherein the table top is rotatable, relative to the base and there is further provided, a device for restraining free rotation of the table top.

19. The height adjustable table assembly as claimed in claim 18 wherein the device for restraining free rotation of the table top is in the form of a resiliently deformable tether to connect the table top to a portion of the table assembly other than the rotatable member or any other portion of the height adjustment mechanism which is rotatable with the rotatable member.

20. The height adjustable table assembly as claimed in claim 19 wherein the resiliently deformable tether is in the form of a curved or bent rod or bar.

21. The height adjustable table assembly as claimed in claim 20 further including upper and lower shrouds to shroud part of the height adjustment mechanism, the table top being tethered via the resiliently deformable tether to the upper shroud.

22. The height adjustable table assembly as claimed in claim 21 wherein the upper shroud is rotatable relative to the lower shroud which is-fixed relative to the supporting base.

23. The height adjustable table assembly as claimed in claim 22 wherein the relative rotation movement is braked by a friction imparting device disposed between the upper and lower shrouds.

24. The height adjustable table assembly as claimed in claim 23 wherein the friction imparting device is an O-ring.

25. A table assembly comprising: a table top; a support assembly for the table top including a supporting base, the table top being rotatable relative to the supporting base; and a resiliently deformable tether interconnecting the table top and at least a portion of the support assembly.

26. The table assembly as claimed in claim 25 wherein the resiliently deformable tether is in the form of a spring arm.

27. The table assembly as claimed in claim 26 wherein the spring arm comprises a bent rod or bar, bent back on itself thereby defining two arms, one of which is connected to the table top and the other of which is connected to said portion of the support assembly.

28. The table assembly as claimed in claim 27 wherein the arm connected to the table top is inserted into the table top through the side thereof.

29. The table assembly as claimed in claim 28 of the type which is height adjustable.

30. The table assembly as claimed in claim 25 wherein the support assembly comprises a telescopic leg assembly having two telescopically cooperating members, a first of said members comprising said portion of the support assembly to which the resiliently deformable tether is connected, the second of said members comprising the supporting base or being fixedly connected to the supporting base.

31. The table assembly as claimed in claim 30 wherein the two telescopic members are rotatable relative to one another, there being further provided a brake to resist relative rotational motion.

32. The table assembly as claimed in claim 31 wherein the brake is in the form of a friction imparting device placed between the two telescopic members.

33. The table assembly as claimed in claim 32 wherein the friction imparting device is in the form of an O-ring.

34. A height adjustable table assembly comprising:

a table top having an upper surface and an outer periphery;

a supporting base;

a height adjustment mechanism including: a threaded spindle and an internally threaded nut which is fixed relative to the supporting base, the threaded spindle being received within the threaded nut for rotation; and a height adjustment actuator in the form of a rotatable member which is in connection with the threaded spindle, the rotatable member supporting the table top and being selectively rotatable relative to the supporting base to rotate the spindle within the nut to effect height adjustment of the rotatable member and the table top, the rotatable member being disposed underneath the upper surface of the table top and having an outer edge which terminates at or near the outer periphery of the table top for the entirety of the outer periphery of the table top.

35. The height adjustable table assembly as claimed in claim 34 further including a support assembly in the form of upper and lower shrouds telescopically received one within the other, the upper and lower shrouds housing the threaded spindle and nut, the lower shroud being fixed relative to the supporting base and the upper shroud being in connection with the rotatable member.

36. The height adjustable table assembly as claimed in claim 35 wherein the upper shroud is in connection with the spindle via a bearing housing.

37. The height adjustable table assembly as claimed in claim 36 wherein the upper shroud and the lower shroud are rotatable relative to one another.

38. The height adjustable table assembly as claimed in claim 37 wherein the relative rotational movement between the upper shroud and the lower shroud is braked.

39. The height adjustable table assembly as claimed in claim 30 wherein the relative rotation movement is braked by a friction imparting device disposed between the upper and lower shrouds.

40. The height adjustable table assembly as claimed in claim 39 wherein the friction imparting device is in the form of an O-ring.

41. The height adjustable table assembly as claimed in claim 34 wherein the table is of the type having a single generally central support leg with the table being circular and the rotatable member being annular.

42. The height adjustable table assembly as claimed in claim 34 wherein the table top is supported on the rotatable member through the use of bearings to allow the rotatable member to rotate relative to the table top.

43. The height adjustable table assembly as claimed in claim 35, wherein the table top is supported on the rotatable member through the use of bearings to allow the rotatable member to rotate relative to the table top, further including a resiliently deformable tether in the form of a curved or bent rod or bar, whereby the tether interconnects the table top and the upper shroud.

44. The height adjustable table assembly as claimed in claim 34, the table top and the rotatable member each comprising a central axis, wherein the central axis of the table top is substantially aligned with the central axis of the rotatable member.

45. A height adjustable table assembly comprising:

a first table top;

a first support base for supporting the first table top;

a second table top;

a second support base for supporting the second table top, the second table top being rotatable in relation to the second support base;

a resiliently deformable tether attached to the second table top and the second support base to prevent free rotation of the second table top; and a height adjustment mechanism to selectively raise or lower the second table top relative to the second support base, the height adjustment mechanism including a height adjustment actuator in the form of a rotatable member which is selectively rotatable relative to the second support base to selectively raise or lower the second table top, the rotatable member being substantially axially aligned with the second table top.

46. The height adjustable table assembly as recited in claim 45, the second table top further comprising an outer periphery and the rotatable member further comprising an outer edge, wherein the outer edge of the rotatable member terminates at or near the outer periphery of the second table top for at least a portion of the outer periphery of the second table top.

47. The height adjustable table assembly as recited in claim 45, wherein the height adjustable mechanism further comprises:

a threaded spindle which is attached to the rotatable member; and an internally threaded nut which is fixedly attached relative to the second support base, the threaded spindle engaging the internally threaded nut.

48. The height adjustable table assembly as recited in claim 45, wherein the second support base comprises an upper shroud and a lower shroud telescopically disposed in relation to each other, wherein an O-ring is disposed between the upper and lower shrouds, and wherein at least a portion of the height adjustable mechanism is disposed within the upper and lower shrouds.

* * * * *

UNITED STATES PATENT AND TRADEMARK OFFICE

CERTIFICATE OF CORRECTION

PATENT NO. : 6,536,357 B1
DATED : March 25, 2003
INVENTOR(S) : Bernard Anton Hiestand It is certified that error appears in the above-identified patent and that said Letters Patent is hereby corrected as shown below:

Column 11,
Line 65, before “movement” change “rotation” to -- rotational --

Column 12,
Line 35, before “movement” change “rotation” to -- rotational --

Signed and Sealed this

Tenth Day of June, 2003

JAMES E. ROGAN
*Director of the United States Patent and Trademark Office*